US007549370B2

(12) United States Patent
Lehto

(10) Patent No.: US 7,549,370 B2
(45) Date of Patent: Jun. 23, 2009

(54) ACTUATOR MEANS TO ACCOMPLISH A LINEAR MOVEMENT

(75) Inventor: Tony Lehto, Paimio (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 11/914,654

(22) PCT Filed: May 2, 2006

(86) PCT No.: PCT/FI2006/050175

§ 371 (c)(1),
(2), (4) Date: Nov. 16, 2007

(87) PCT Pub. No.: WO2006/123014

PCT Pub. Date: Nov. 23, 2006

(65) Prior Publication Data

US 2008/0210107 A1 Sep. 4, 2008

(30) Foreign Application Priority Data

May 20, 2005 (FI) ..... 20055241

(51) Int. Cl.
*B30B 3/04* (2006.01)

(52) U.S. Cl. ..... 100/163 R; 100/170; 100/269.01; 92/143; 92/183; 92/169.1

(58) Field of Classification Search ..... 100/162 B, 100/163 R, 163 A, 164, 168–170, 269.01; 92/143, 169.1, 181 R, 182, 183
See application file for complete search history.

(56) References Cited

U.S. PATENT DOCUMENTS 3,893,377 A 7/1975 Mannetje
4,026,523 A 5/1977 Gratzmuller
4,924,772 A * 5/1990 Schlunke et al. ..... 100/163 R
4,981,070 A 1/1991 Larsen
5,007,276 A 4/1991 Kadis et al.

(Continued)

FOREIGN PATENT DOCUMENTS

EP 0819638 A2 1/1998

(Continued)

OTHER PUBLICATIONS

Search Report issued in PCT/FI2006/050175.

(Continued)

*Primary Examiner*—Jimmy T Nguyen
(74) *Attorney, Agent, or Firm*—Stiennon & Stiennon

(57) ABSTRACT

A regulating unit for accomplishing a linear movement includes a cylindrical frame part (1) having a cylinder part (11) and cylinder head (12), which define a piston space (131, 132), and a piston unit (2) to be moved by a pressurized medium in the piston space. The height of a first space (131), in which a piston part (22) is moveable, is bigger than the height of a piston part, the cross section area is bigger than a cross section area of a piston rod. A cross section area of a second space (132) is smaller that the cross section area of the piston part. Pressurized medium may be fed into a cavity space (15), which is between the facing surfaces of the piston part and the piston space, for moving the piston unit towards the cylinder head (12) or vice versa.

14 Claims, 2 Drawing Sheets

U.S. PATENT DOCUMENTS

| | | | | |
|---|---|---|---|---|
| 5,806,415 | A * | 9/1998 | Lipponen et al. | 100/35 |
| 6,272,968 | B1 | 8/2001 | Ropponen | |
| 6,521,090 | B1 * | 2/2003 | Vestola et al. | 162/199 |

FOREIGN PATENT DOCUMENTS

| | | | |
|---|---|---|---|
| EP | 1316733 | A1 | 6/2003 |
| GB | 1371436 | | 10/1974 |
| JP | 55-123003 | | 9/1980 |
| TW | 565658 | B | 12/2003 |
| WO | 2006/123014 | A1 | 11/2006 |

OTHER PUBLICATIONS

English translation of abstract in EP 0819638.
English translation of abstract in JP 55-123003.
English translation of abstract in TW 565658.

* cited by examiner

ACTUATOR MEANS TO ACCOMPLISH A LINEAR MOVEMENT

CROSS REFERENCES TO RELATED APPLICATIONS

This application is a U.S. national stage application of international app. No. PCT/FI2006/050175, filed May 2, 2006, the disclosure of which is incorporated by reference herein, and claims priority on Finnish app. No. 20055241, Filed May 20, 2005.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention is connected to a fiber web machine, such as to paper machines and to tissue-paper machines and to cardboard machines and chemical pulp machines. The present invention, in more detail, relates to the regulating unit for the accomplishing of a linear movement, which is suitable for example for an active attenuation cylinder of the machine bodies and pipe systems of the fiber web machine, such as for example a power cylinder.

At the moment, there are not available such solutions on the market that would serve as a regulating unit, which produces the linear movement fast enough and/or reaches a sufficient power level.

There has been disclosed in a publication EP 819638 a reeling unit, in which the vibration of a press roller is dampened in two different ways. The press roller of the reeling unit, which has been presented in the publication, is a roller, which is pressed against the surface of the fiber web reel, which is under reeling process, and around which the fiber web to be reeled is wound. The press roller is pressed against the surface of the fiber web reel by precisely defined power and the position of the press roller is adjusted by means of load cylinders, which affect to the bearing housings, which loading cylinders can be pneumatic and/or hydraulic cylinders. According to an example, a pressure cylinder is fastened to a bearing housing or a rack is placed next to the bearing housing, which rack comprises a moving mass that has been placed between the load cylinders, in which case the load cylinders and the moving mass form a vibrator, which can be dimensioned to dampen appearing vibrations. According to another example, a pressure cylinder is fastened to the bearing housing, the pressure lines of the pressure cylinder being provided with a throttle means to dampen the movement of the cylinder. This kind of the pressure cylinder can be composed of the load cylinder of the pressing roller, which is throttled by a suitable way. This kind of a known damper solution is suitable for dampening of the vibrations of the roller, which moves actively, but this kind of a known damper solution does not have a direct effect on the vibrations of the machine skeleton or body. Furthermore, it is problematic, because the known damper solution is suitable to be installed only horizontally installed on a fixed base, because otherwise the mass of the known of the cylinder. This kind of the pressure cylinder can be composed of the load cylinder of the pressing roller, which is throttled by a suitable way. This kind of a known damper solution is suitable for dampening of the vibrations of the roller, which moves actively, but this kind of a known damper solution does not have a direct effect on the vibrations of the machine skeleton or body. Furthermore, it is problematic, because the known damper solution is suitable to be installed only horizontally installed on a fixed base, because otherwise the mass of the known damper solution causes an extra load to the supports and bearing housings of rollers. Furthermore, the weakness is that the known damper solution cannot be applied for a multi-nip-calender, in which the vibration frequencies are so big and quick that the known damper solution does not have time to react but the known solutions even may increase the vibration sensitivity.

SUMMARY OF THE INVENTION

An object of the present invention is to eliminate or to reduce at least essentially drawbacks and weaknesses, which are related to the known technique. Another object of the present invention is to accomplish a new and inventive regulating unit, which could be used to produce a linear movement, which could produce the linear movement quickly and/or with sufficient power level. A third object of the present invention is to accomplish a new and inventive regulating unit for accomplishing the linear movement, which unit would be suitable for example for an active attenuation cylinder of the machine skeletons and pipe systems of the fiber web machine.

Generally, these objects can be achieved by a regulating unit for accomplishing a linear movement, which regulating unit includes the frame part, which is advantageously a cylindrical frame part, which comprises a cylinder part and cylinder head, which define a piston space to their inside, and a piston unit, which is arranged to be moved by means of pressurized medium in the said space for the piston that is inside the frame part, for example so that a form of the piston unit corresponds essentially to the piston space such that the said piston space includes a first space and a second space, a height of which first space, in which a piston part is moveable, is bigger than the facing height of a piston part of the said piston unit, a cross section area of which first space is bigger than a cross section area of a piston rod of the said piston unit, a cross section area of which second space, in which the piston rod is moveable with the piston part of the piston unit, is smaller that the cross section area of the cross section area of the said piston part, and that there are arranged means in the connection of the frame part for feeding pressurized medium into a cavity space, which is between the facing surfaces of the said piston part and the said first piston space, for moving the piston unit towards the cylinder head or vice versa.

So the invention is based generally on the quick regulating unit response, which is accomplished according to an example of the present invention by means of a combination of one or more quick feeding valve, each valve having a high frequency valve response, which is advantageously of a class of about 2 kHz, and of one or more short feeding channel for a pressurized medium, whereby any delay caused thereof is as small as possible for feeding the pressurized medium from a container of the pressurized medium into cavity space, which is between facing parts of the piston part and the piston space, and thus to move the piston unit in the piston space.

According to a preferred embodiment of the invention, sealing leaks can be controlled by means of leak channels, which have been formed to a wall, which defines the piston space in the cylinder part, advantageously face-to-face with piston rings, which are in the piston unit. According to a realization example the leak channel is formed by a milled set of grooves or by a groove, from which the leak of the pressurized medium can be directed to a silencer and/or to the leak line of the pressurized medium.

According to the invention, the pressurized medium, which controls the regulating unit, can be fluid or gaseous medium and in the control it is advantageous to adapt a feedback and utilize either a linear sensor or a power sensor as the sensor.

The regulating unit, which is in accordance with the invention, can also be controlled naturally proportionally without the feedback.

The advantage of the present invention also is that, in addition to the dampening function, the regulating unit is also applicable for example as

- a testing cylinder, by which vibration of the hydraulic pipe system can be tested,
- a sub-cylinder, by which mistakes of a quick control cylinders having longer strokes can be corrected,
- a braking cylinder for non-locking industrial brake applications, and
- organs, by which a quick change in the volume can be produced in a container.

BRIEF DESCRIPTION OF THE DRAWINGS

Other details of the present invention become clear in the following description of a preferred embodiment example, in which description have been referred to the figure.

DESCRIPTION OF THE PREFERRED EMBODIMENTS

Figure 1:
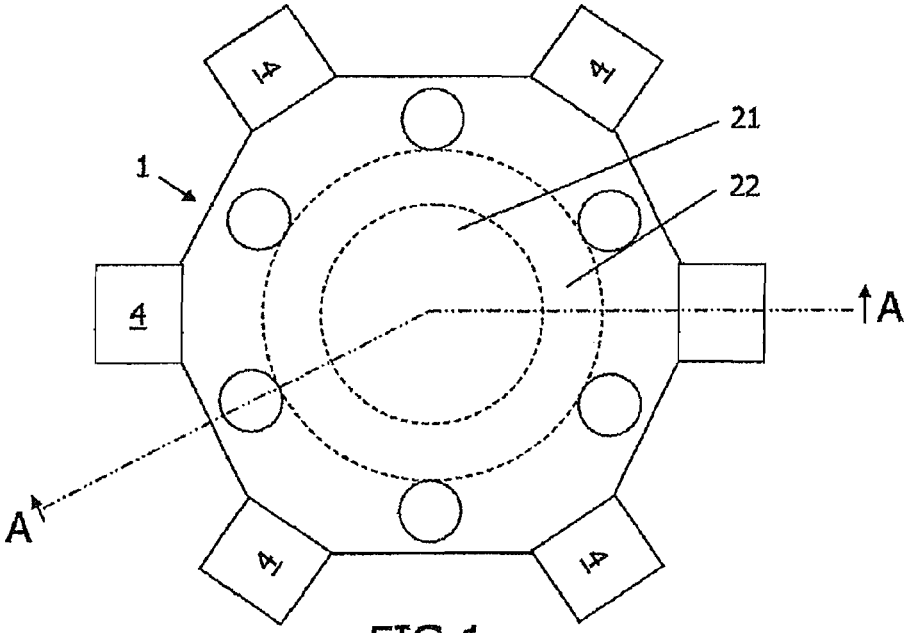
FIG. 1 represents from underneath the regulating unit, which is in accordance with the advantageous embodiment of the present invention.
Figure 2:
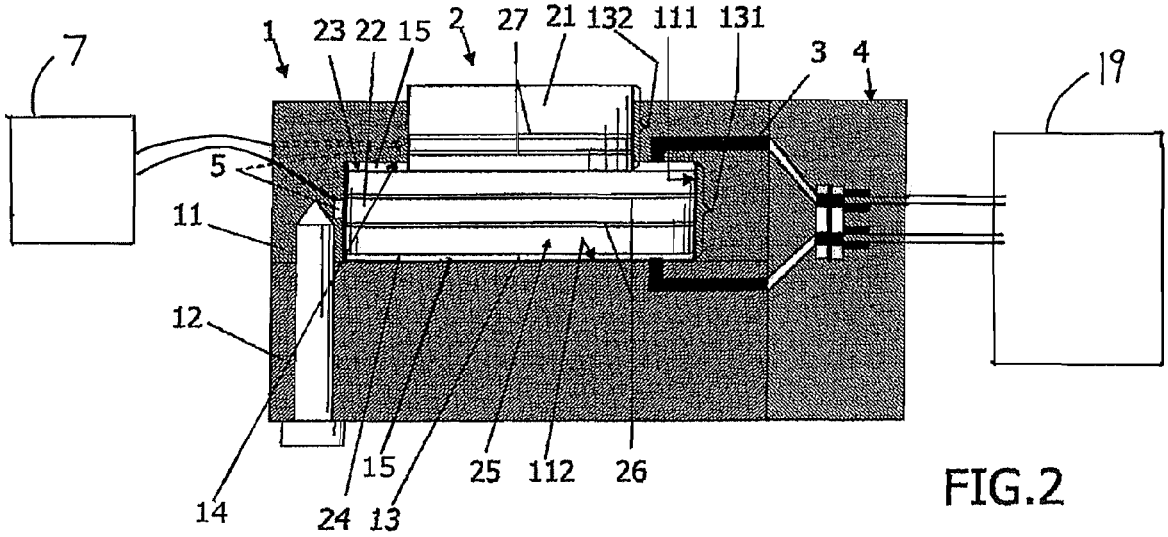
FIG. 2 represents a cross sectional view of the regulating unit, which is along the line 2-2 of FIG. 1.

In the embodiment of FIG. 1 and FIG. 2 the regulating unit includes for accomplishing the linear movement a frame part 1, which is advantageously a cylindrical frame part, which comprises a cylinder part 11 and cylinder heads 12, which have been connected by means of a bolted joint. Of course, it is possible that the frame part has been formed of one piece for example by a chipping processing. Inner surface 111 of the cylinder part and the inner surface 112 of the cylinder head define the piston space 131, 132 inside the cylinder part and the piston unit 2 is arranged to be moved by means of a pressurized medium inside the piston space of the frame part.

The piston unit 2 of the regulating unit, which is in accordance with the present invention, comprises a central rod part, in other words the piston rod 21 which is directed upwards in the figure FIG. 2, and an extension part as the lengthening of the piston rod, in other words piston part 22, which is directed towards the cylinder head 12 as the lengthening of the piston rod, in FIG. 2. This kind of a piston unit 2, which is composed of the piston rod and of the extension as the lengthening thereof, in other words of piston part, has been arranged to move back and forth by means of the pressurized medium in the piston space 131, 132.

In a piston part 22 comprises at the side of the piston rod a first surface 23, from which the piston rod 21 extends that hence defines the first surface as ring-like forehead surface 23, and the second surface on the side of the cylinder head 24, which is depicted as a flat surface 24, as it is shown in the FIG. 2, or as a form surface (not presented in the figures), for example as a convex surface or a concave surface, towards the cylinder head 12.

The piston part 22 of the piston unit 2 comprises the cylindrical circle surface 25, which is between the first surface 23 and the second surface 24. The circle surface has been equipped with the piston rings 26 to secure tightness. It is advantageous according to the invention that the piston rod 21 of the piston unit also has been equipped with the piston rings 27 for securing the tightness.

In the regulating unit, which is a hydraulic power cylinder and which is in accordance with the present invention and FIGS. 1 and 2, the form of the piston unit 2 corresponds essentially to the form of the piston space 131, 132. The piston space comprises the first space 131, in which the piston part moves 22, and the second space 132, in which moves with the piston part the piston rod 21, the cross section area of which is smaller than the cross section area of the piston part.

The height of the first part is bigger than that of the piston part 22, in which case the piston part can move back and forth by the amplitude that corresponds to the height difference. Furthermore, the cross section area of the first space is bigger than the cross sections area of the piston rod 21 in piston space. Because the cross section area of the second space 132 of the piston space is smaller than the cross section area of the first space 131 of the piston space and/or piston part 22, there is formed in the piston space stairs, which operate as a stepped surface, which restricts the movement of the piston unit into one direction, which is directed away from cylinder head 12. Thus the stepped surface forms a facing radial surface 14 for the forehead surface 23 of the piston part. The distance of the facing surface from the cylinder head is bigger than the height of the piston part 22.

For moving the piston unit 2 in the frame part 1 towards the cylinder head 12 or vice versa, there are or have been arranged connection of the frame part 1 means 1 for directing pressurized medium into cavity space 15, which is between the piston part 22 and the facing walls, i.e. between the first forehead surface 23 or the second surface 24, and the response wall 14, of the first space 13.

In the embodiment, which is in accordance with the figures FIG. 1 and FIG. 2, there are six pieces of means for directing the pressurized medium into the regulating unit, which means have been arranged at the outer circle of frame part 1 with even spaces. Each means includes the feeding channel of the pressurized medium and feeding valve 4, which is fitted in the feeding channel 3, which is in a flow connection to the container 19 of the pressurized medium, which can be for example a hydraulic reservoir, if the pressurized medium is fluid, or a pneumatic reservoir, if the pressurized medium is gaseous.

It is especially characteristic to the regulating unit, which is in accordance with the present invention, the quick regulating unit response, which can move the piston unit 2 with a desired amplitude and frequency in the piston spaces 131, 132. The desired amplitude can be accomplished with mutual dimensioning of the piston unit 2 and the piston space 131, 132.

The quick regulating unit response, which is characteristic to the invention, can be reached by a combination of the quick feeding valves 4, which means a high level valve response that is advantageously of about 2 kHz, and the short feeding channels 3 for the pressurized medium, whereby the consequence of the short flow distance of the pressurized medium from the container of the pressurized medium inside the regulating unit and into cavity space 15 is that the piston unit moves fast inside the piston space and also that the delays are as small as possible.

A leak of the pressurized medium between the piston space 131, 132 and the piston unit 2 can happen due to the high pressures of the pressurized medium used in the regulating. For the minimizing of this kind of a sealing leak at least one leak channel 5 has been arranged in the inner wall 111 of the cylinder part 11, which defines the piston space of the cylinder unit 1, which leak channels has been advantageously formed face-to-face with the piston rings 26 of the piston part 22 of the piston unit and/or with the piston rings 27 of the piston rod 21 of the piston unit. This kind of a leak channel can be for example a milled set of grooves or a groove in the wall of the cylinder wall that defines the piston space, through which the leak of the pressurized medium can be directed to a silencer 7 and/or to the leak line of the pressurized medium.

According to the present invention, the pressurized medium, which controls the regulating unit, can be a fluid or gaseous medium. In case the pressurized medium is the fluid medium, such as oil, it is advantageous that the means 3, 4 for directing pressurized fluid, such as the oil, are arranged in connection with the frame part 1 and in flow connection with a hydraulic reservoir that is in a close vicinity of the frame part. Then the amount of 4 fluid mediums to be needed by the quick feeding valves can be fed to the regulating unit with a short delay. If the pressurized medium is a gaseous medium, for example air, the feed pressure for directing the pressurized medium to the regulating unit can be even 20 MPa or higher. Then by the pneumatics application can be achieved same power levels as by the hydraulic application.

In order to achieve a desired power level and an amplitude of a desired size, and the quick frequency of the operation, the control of the regulating unit, which is in accordance with the present invention, can be carried out by means of the feedback control, in which the linear sensor or the power sensor can function as the sensor. The control can also be proportionally carried out without the feedback. The feeding valve of the regulating unit itself can be controlled electrically or can be as such a reel controlled valve.

The invention has described above only by means of a preferred embodiment example. However, this does not intend to define the invention by any means and many alternatives and modifications as well as functionally equivalent solutions are possible within the inventive idea, which has been defined by the enclosed set of patent claims.

So one must note that in addition to the regulating function the regulating unit is also applicable for example as

Figure 3:
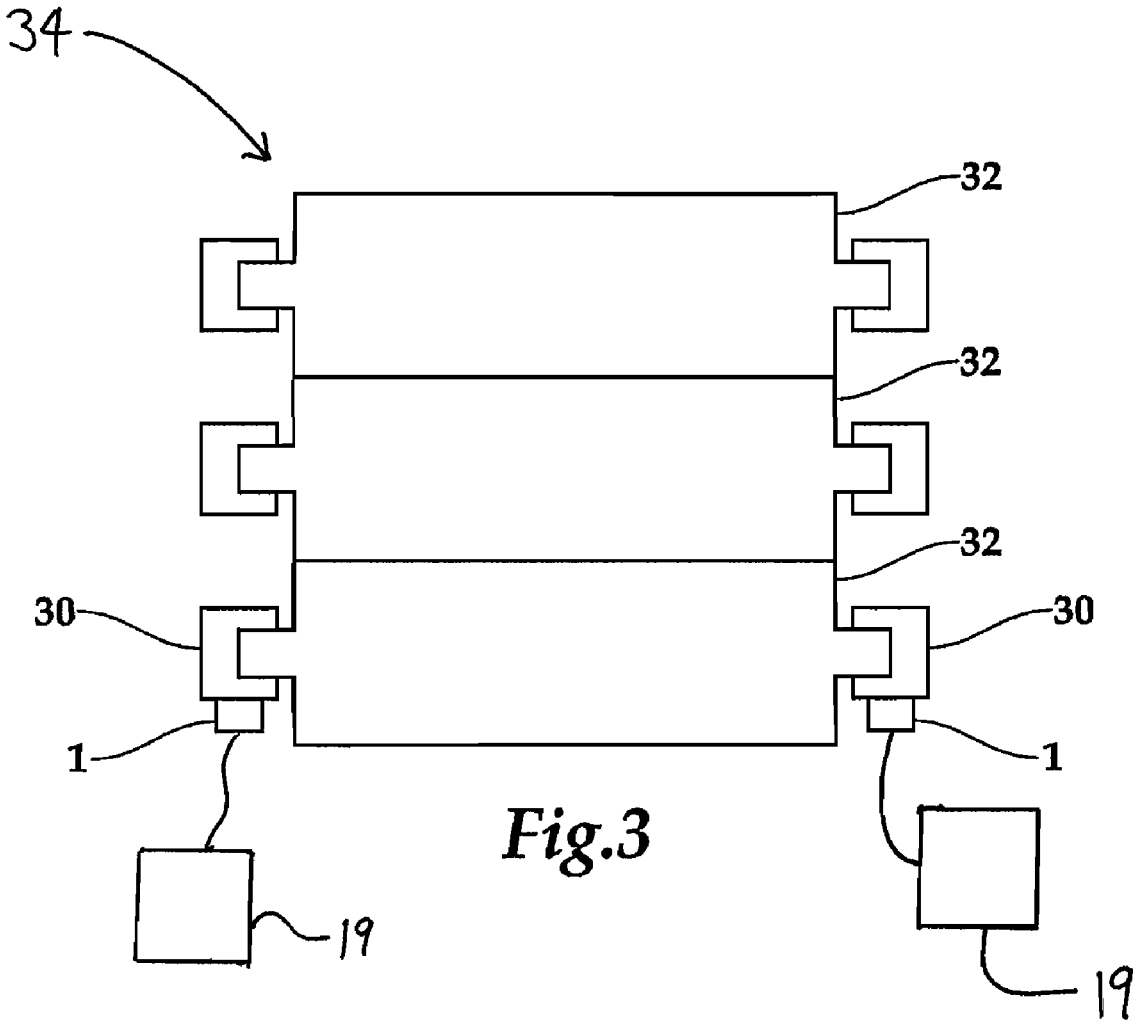
FIG. 3 is a schematic view of the regulating unit of FIG. 1 applied to the bearing housing of a roll of a multi-nip calender.

- a vibration damping unit engageable with the housing 30 of a roll 32 of a multi-nip calender 34, as shown in FIG. 3,
- a testing cylinder, by which vibration of the hydraulic pipe system can be tested,
- a sub-cylinder, by which mistakes of a quick control cylinders having longer strokes can be corrected,
- a braking cylinder for non-locking industrial brake applications, and
- organs, by which a quick change in the volume can be produced in a container.

The invention claimed is:

1. An active vibration attenuation cylinder unit, for a fibre web machine comprising:

a cylindrical frame part, having a cylinder part and a cylinder head defining a piston space therebetween, the piston space having a first piston space of cylindrical shape having a first cylindrical height, and a first cross section area, and a second piston rod space of cylindrical shape having a second cross section area less than the first cross section area;

a piston unit formed of a cylindrical piston part having a lower surface and an upper annular surface surrounding a cylindrical piston rod joined to the piston part, the piston part having a second height of less than the first cylindrical height of the first piston space, the piston unit mounted in the piston space for linear movement, with the piston part mounted for motion in the first piston space, together with the piston rod which is mounted for motion in the second piston rod space;

a container of pressurized fluid medium; and a plurality of valves having response times of about 2 kHz connected between the container of pressurized fluid medium and feed channels, the valves and the feed channels spaced about the cylindrical frame part, the feed channels connected to the piston space at an upper annular surface overlying the upper annular surface of the piston part surrounding the cylindrical piston rod, and the feed channels connected at a lower surface underlying the lower surface of the cylindrical piston part so that actuation of the valves causes the piston unit to oscillate.

2. The apparatus of claim 1 wherein there are six valves spaced about the cylindrical frame part.

3. The apparatus of claim 1 wherein the valves and the feed channels are evenly spaced about the cylindrical frame part.

4. The apparatus of claim 1 wherein the first piston space of cylindrical shape is defined by a cylindrical inner wall, and wherein the cylindrical piston part has a cylindrical surface equipped with piston rings, and wherein the cylindrical part of the cylindrical frame part has portions defining at least one leak channel which opens onto the cylindrical inner wall, which leak channel is face-to-face with the piston rings of the piston of the cylindrical piston part.

5. The apparatus of claim 4 wherein the at least one leak channel is composed of a groove in the cylindrical inner wall that defines the piston space of the cylinder part through which at least one leak channel the leak of the pressurized fluid medium is directed to a silencer.

6. The apparatus of claim 1 wherein the container of pressurized fluid medium is a hydraulic reservoir arranged in a close vicinity of the frame part, whereby the plurality of valves can be fed with a selected amount of pressurized fluid medium.

7. The apparatus of claim 1 wherein the container of pressurized fluid medium is a source of a gaseous medium at about 20 Mpa.

8. A multi-nip-calender comprising:

a first calender roll having a bearing housing and an active vibration attenuation cylinder unit applied to said bearing housing, the active vibration attenuation cylinder unit further comprising:

a cylindrical frame part having a cylinder part and a cylinder head, defining a piston space therebetween, the piston space having a first piston space of cylindrical shape having a first cylindrical height, and a first cross section area, and a second piston rod space of cylindrical shape having a second cross section area less than the first cross section area;

a piston unit formed of a cylindrical piston part having a lower surface and an upper annular surface surrounding a cylindrical piston rod joined to the piston part, the piston part having a second height of less than the first cylindrical height of the first piston space, the piston unit mounted in the piston space for linear movement, with the piston part mounted for motion in the first piston space, together with the piston rod which is mounted for motion in the second piston rod space;

a container of pressurized fluid medium;

a plurality of valves having response times of about 2 kHz connected between the container of pressurized fluid medium and feed channels, the valves and the feed channels spaced about the cylindrical frame part, the feed channels connected to the piston space at an upper annular surface overlying the upper annular surface of the piston part surrounding the cylindrical piston rod, and the feed channels connected at a lower surface underlying the lower surface of the cylindrical piston part so that actuation of the valves causes the piston unit to oscillate.

9. The apparatus of claim 8 wherein there are six valves spaced about the cylindrical frame part.

10. The apparatus of claim 8 wherein the plurality of valves and the feed channels are evenly spaced about the cylindrical frame part.

11. The apparatus of claim 8 wherein the first piston space of cylindrical shape is defined by a cylindrical inner wall, and wherein the cylindrical piston part has a cylindrical surface equipped with piston rings, and wherein the cylindrical part of the cylindrical frame has portions defining at least one leak channel which opens onto the cylindrical inner wall, which leak channel is face-to-face with the piston rings of the piston of the cylindrical piston part.

12. The apparatus of claim 11 wherein the at least one leak channel is composed of a groove in the cylindrical inner wall that defines the piston space of the cylinder part through which at least one leak channel the leak of the pressurized medium is directed to a silencer.

13. The apparatus of claim 8 wherein when the container of pressurized fluid medium is a hydraulic reservoir arranged in a close vicinity of the frame part, whereby the plurality of valves can be fed with a selected amount of pressurized medium.

14. The apparatus of claim 8 wherein the container of pressurized fluid medium is a source of a gaseous medium, at about 20 Mpa.

* * * * *